US006098633A

United States Patent [19]

Pabari

[11] Patent Number: 6,098,633

[45] Date of Patent: Aug. 8, 2000

[54] HAIR COMB

[76] Inventor: Shantilal Pabari, 6 Coppen Road, Dagenham, Essex RM8 1HJ, United Kingdom

[21] Appl. No.: 09/375,335

[22] Filed: Aug. 16, 1999

[30] Foreign Application Priority Data

Oct. 2, 1998 [GB] United Kingdom ..... 9821493
Apr. 26, 1999 [GB] United Kingdom ..... 9909609

[51] Int. Cl.[7] ..... A45D 24/04

[52] U.S. Cl. ..... 132/142; 132/137; 132/159; 43/112

[58] Field of Search ..... 132/142, 137, 132/187, 157, 159, 212, 219, 160, 161, 163, 152, 153; 43/112, 136; 119/87, 83, 86, 156

[56] References Cited

U.S. PATENT DOCUMENTS

| | | | |
|---|---|---|---|
| 1,425,937 | 8/1922 | Biderman . | |
| 1,950,667 | 3/1934 | Fulton | 132/11 |
| 2,655,925 | 10/1953 | Uivad | 132/142 |
| 3,133,546 | 5/1964 | Dent | 132/142 |
| 4,187,866 | 2/1980 | Zwiren et al. | 132/151 |
| 4,807,652 | 2/1989 | Bachrach | 132/137 |
| 4,815,232 | 3/1989 | Rawski | 43/136 |
| 4,936,259 | 6/1990 | Owen et al. | 119/83 |
| 5,343,881 | 9/1994 | Golan et al. | 132/143 |
| 5,353,817 | 10/1994 | Kantor et al. | 132/219 |
| 5,636,646 | 6/1997 | Zito | 132/219 |

FOREIGN PATENT DOCUMENTS

| | | |
|---|---|---|
| 900029 | 6/1945 | France . |
| 983262 | 6/1951 | France . |
| 2677234 | 12/1992 | France . |
| 539653 | 8/1941 | United Kingdom . |
| 2066059 | 7/1981 | United Kingdom . |
| 2294200 | 4/1996 | United Kingdom . |
| 9843512 | 10/1998 | WIPO . |

*Primary Examiner*—Gene Mancene
*Assistant Examiner*—Pedro Philogene
*Attorney, Agent, or Firm*—Ladas & Parry

[57] ABSTRACT

A hair comb has a handle (1) having an arcuate portion (2) and a finger grip portion (3). The handle is connected to a spine (4) into which are secured two parallel planes of rows of teeth (10). The teeth (10) are spaced so that a first row of teeth (11) are more widely spaced than a second row of teeth (12), the teeth having a cylindrical cross-section and rounded end tips (13). The spacing between the rows of teeth are such that as the teeth move through hair, the first row perform a first coarse combing for head lice, nits and eggs and the second row of teeth perform a more fine filtering of head lice, nits and eggs.

16 Claims, 3 Drawing Sheets

HAIR COMB

BACKGROUND OF THE INVENTION

1) Field of the Invention

This invention relates to a hair comb and particularly to a hair comb for removing head lice, nits and/or head lice eggs.

2) Description of the Related Art

Fine toothed hair combs are well known. However, known fine toothed combs, which are preferred for smoothing hair to a desired extent, suffer from the disadvantage that they cannot readily be passed through the hair, particularly if the hair is tangled. It is therefore also well known to provide a comb with a single row of teeth in two portions, a second portion having teeth which are more finely spaced than the first portion. Hair may then be first coarsely combed with the more coarsely spaced portion of teeth and then more finely combed with the portion having more finely spaced teeth.

Such an arrangement is not practical for a finely spaced teeth comb for the removal of lice and nits because such a comb has to be passed through the hair in contact with the scalp along the length of the comb. Because of the curvature of the scalp, this restricts the length of a straight comb. Although, in principle, a nit comb of twice the normal length could be used first with one portion, and then with the another portion, this is inconvenient, and there is no guarantee that the comb would be properly used by an inexperienced user. For example, such a user may seek to use the full length of the comb in each pass through the hair, and thereby not keep the whole length of the comb in contact with the scalp.

A hair comb having two rows of teeth is known from GB-539653-A in which a first row of teeth in coarsely spaced and a second row of teeth is finely spaced so that the first row of teeth coarsely combs the hair before the relatively finely spaced teeth comb the hair. The two rows of teeth of the disclosure are preferably formed with a convex curvature to provide a smoothing action on the hair. The teaching of the disclosure is of teeth of one of the rows being shorter than the teeth of the other row. This facilitates the use of the comb at an acute angle to the scalp. The disclosure in this publication is of tapering teeth. The disclosure is also of a preferred spacing of a first row of teeth being an integer multiple of the spacing of the second row of teeth, so that teeth on the finely spaced row may be aligned with spaces between teeth of the more coarsely spaced row of teeth. It is asserted that with this comb the hair can be coarsely combed with the coarsely spaced teeth and finely combed with the finely combed teeth in one motion through the hair.

Such a comb as disclosed in GB-539653-A has a number of disadvantages for the removal of head lice, nits and eggs. The presence of rows of teeth of different lengths means that the comb cannot effectively be used substantially perpendicular to the scalp, which is the preferred orientation for the removal of head lice and nits. Moreover, the tapering shape of the teeth means that there is a tapering space between the teeth, so that a uniform barrier is not presented to the head lice, nits and eggs. Thus, objects of a given size may be trapped in a narrow portion of the tapering space but pass through a wider portion of the tapering space between teeth. The restriction of the spacing of one row of teeth being an integer multiple of the spacing of the second row of teeth also means that the spacings may not be optimised for the entrapment of large lice and smaller lice, nits and eggs.

It is an object of the present invention to provide a comb suitable for the removal of head lice, nits and head lice eggs which at least partially mitigates some of the problems in the prior art.

SUMMARY OF THE INVENTION

According to this invention, there is provided a hair comb including a spine and, extending from the spine in adjacent, substantially parallel planes, a first row of teeth and a second row of teeth, the teeth of the first row of teeth being of substantially the same length as the teeth of the second row of teeth, wherein the spacing of the teeth is arranged for the removal of at least one of head lice, nits and head lice eggs from combed hair.

Preferably the teeth of the second row of teeth are more closely spaced than the teeth of the first row of teeth.

Advantageously the teeth in at least one of the rows of teeth have a substantially cylindrical cross section.

Advantageously the teeth in at least one of the rows of teeth have rounded tips remote from the spine.

Preferably the teeth in at least one of the rows of teeth are made of metal.

Preferably the first and second rows of teeth extend in a direction substantially orthogonally from the spine.

In a preferred embodiment the second row of teeth has at least 20% more teeth per unit length than the first row of teeth.

Advantageously the teeth of the first row are spaced at 8 to 10 teeth per centimeter and the teeth of the second row are spaced at 10 to 12 teeth per centimeter.

In a currently preferred embodiment the teeth of the first row are spaced at 9 teeth per centimeter and the teeth of the second row are spaced at 11 teeth per centimeter.

Advantageously the spacing between the teeth of the first row is approximately 0.48 mm and the spacing between the teeth of the second row is approximately 0.25 mm.

Advantageously the diameter of each tooth of the first and second rows is approximately 0.65 mm to 0.75 mm.

Conveniently handle means is attached to the spine.

Advantageously the handle means is integrally formed with the spine and provided with grip means for assisting a user to grip the handle means.

BRIEF DESCRIPTION OF THE DRAWINGS

The invention will now be described by way of example with reference to the accompanying drawings in which.

In the Figures like reference numerals denote like parts.

DESCRIPTION OF THE PREFERRED EMBODIMENTS

Figure 1:
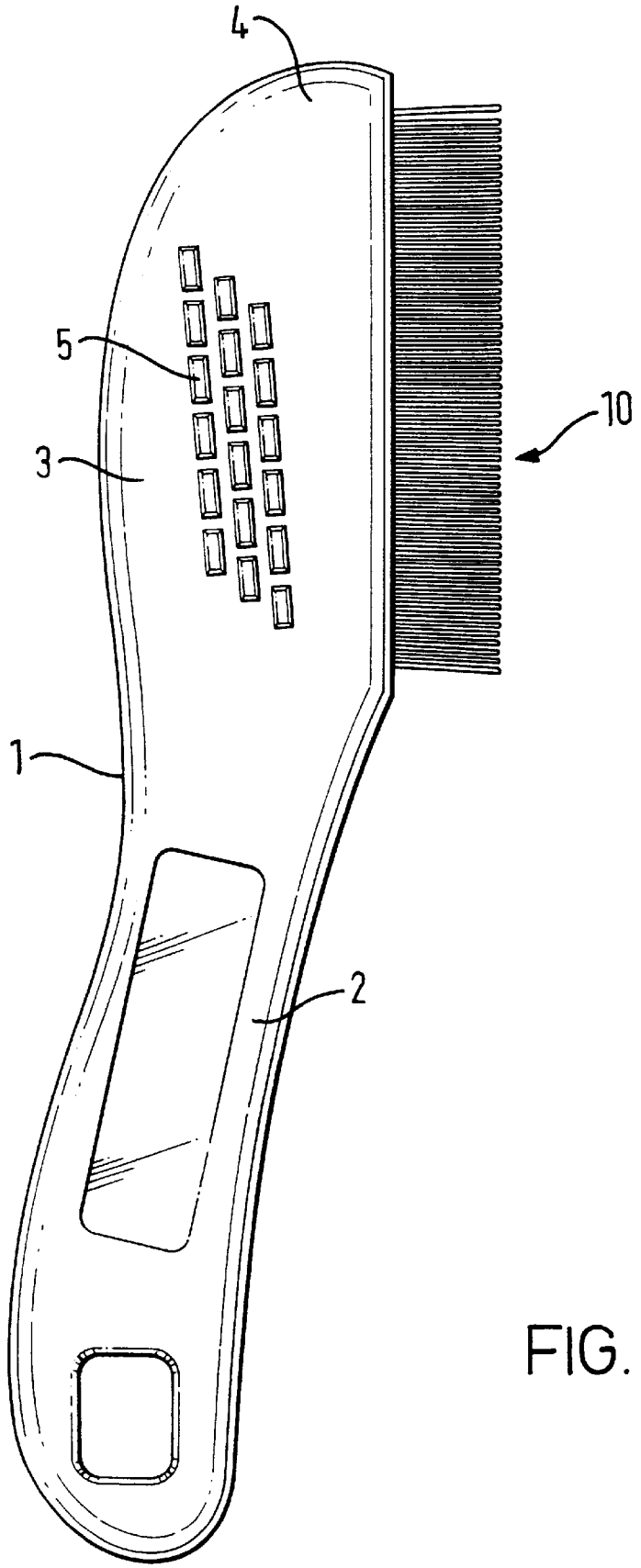
FIG. 1 shows a side view of a comb in accordance with this invention.
Figure 2:
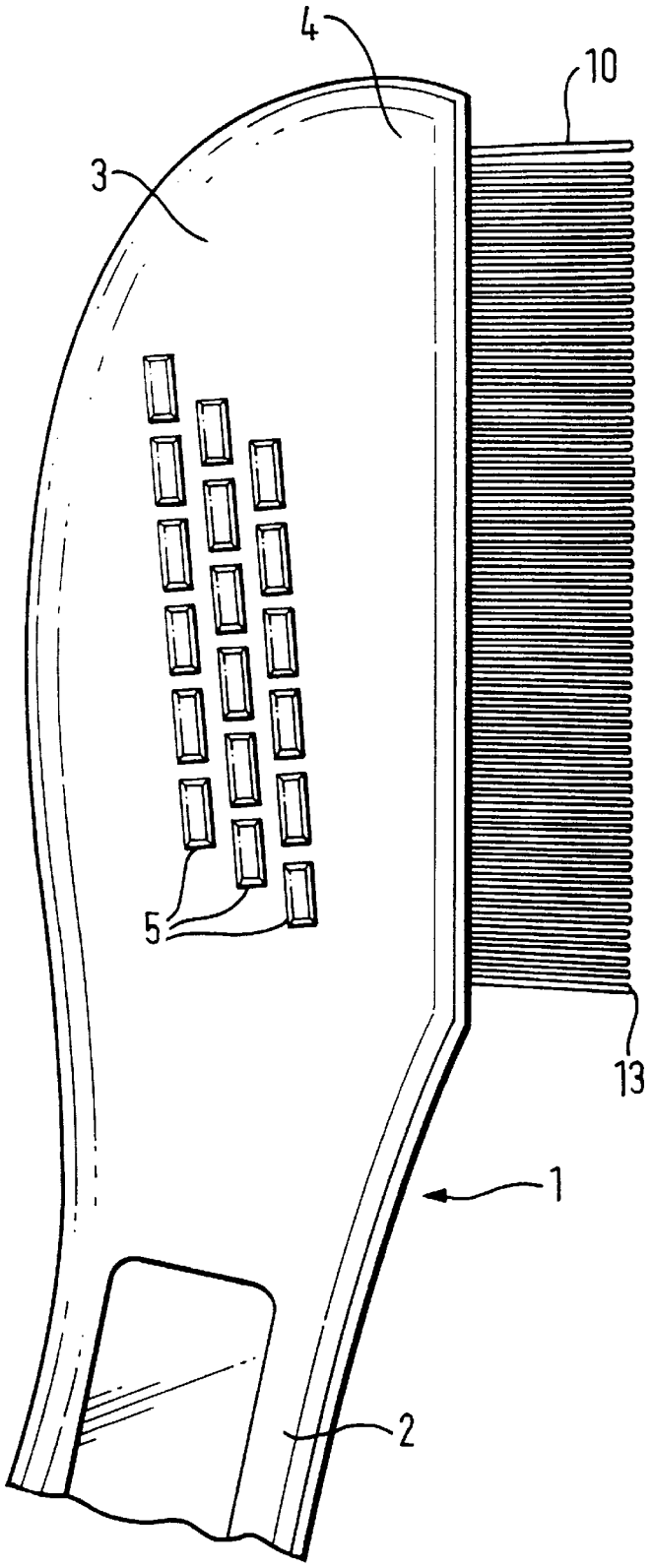
FIG. 2 shows an enlarged partial side view of the comb of FIG. 1.

Referring to FIG. 1, the hair comb has a handle 1 formed by an arcuate portion 2 for being located in the palm of a hand of the user and a finger grip portion 3, a right hand side (shown in FIG. 1) portion of which forms a spine 4 for securing two substantially parallel planes of rows of teeth 10. The finger grip portion 3 includes three parallel spaced rows each of six raised stud portions 5 to assist grip on the handle 1 by a user.

Figure 3:
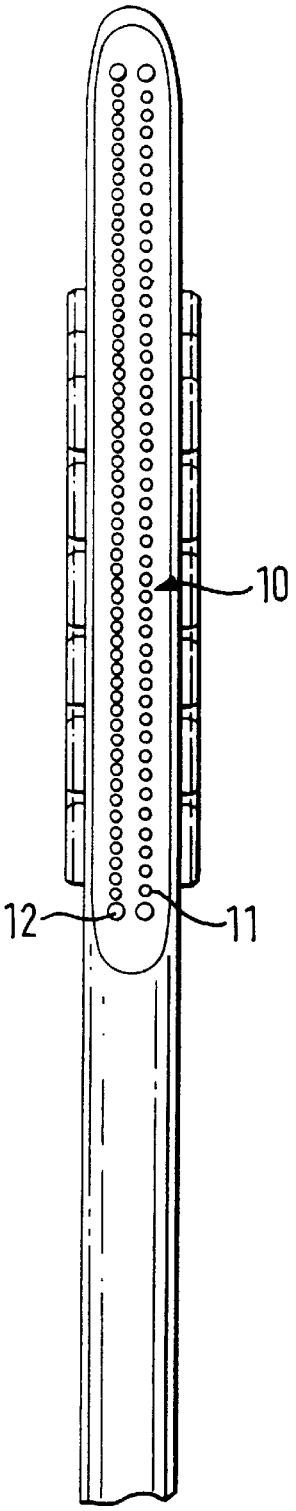
FIG. 3 shows an underside view of the teeth of the comb shown in FIG. 2.
Figure 4:
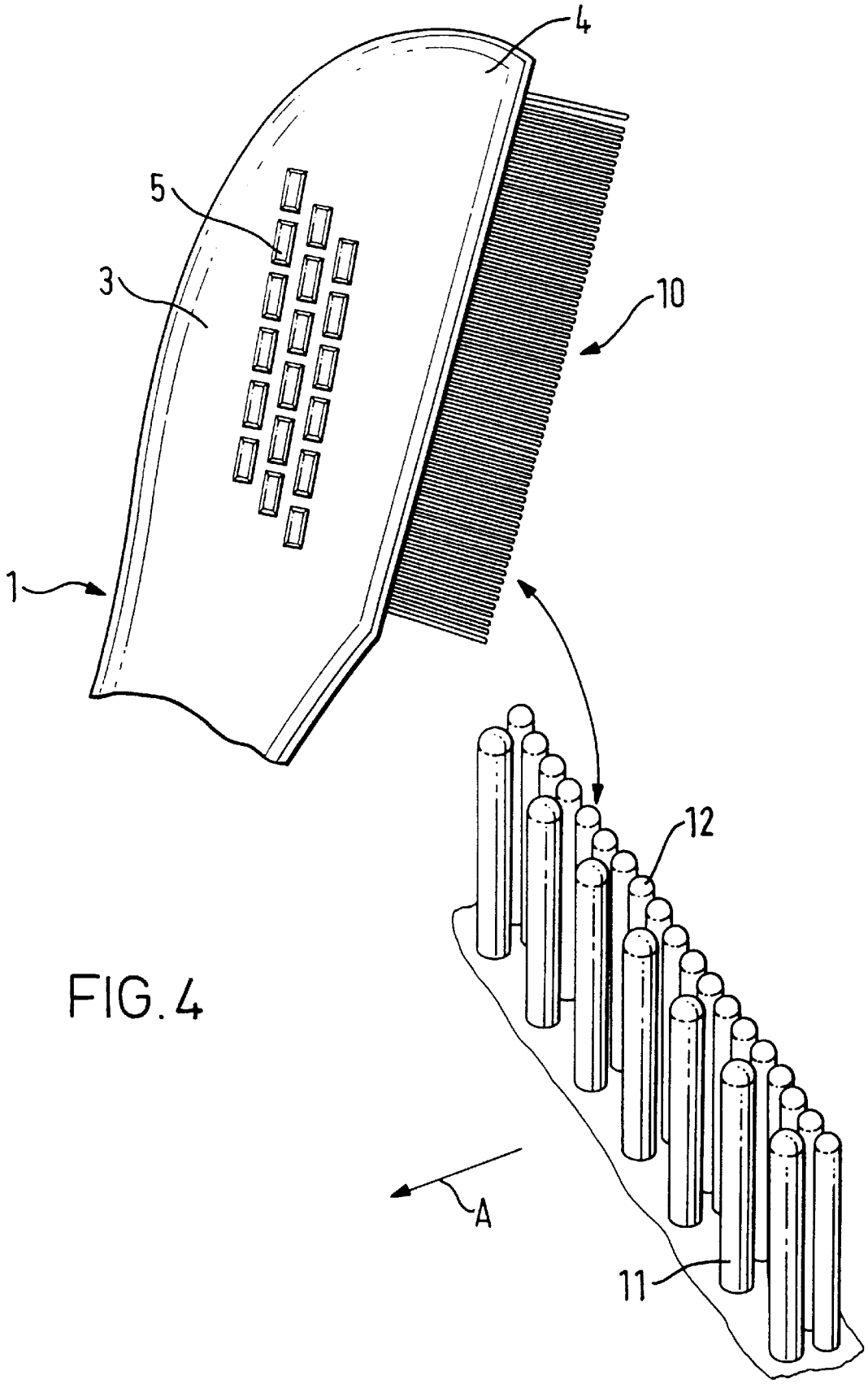
FIG. 4 shows a partial side view of a comb in accordance with this invention and enlarged view of the teeth of the comb.

Referring to FIGS. 3 and 4, the teeth 10 are spaced such that a first row 11 of teeth are more widely spaced than a second row 12 of teeth. The teeth of the rows 11 and 12 have a substantially cylindrical cross-section and the remote end of the teeth from the spine have rounded tips 13. The first and second rows of teeth 11, 12 also have substantially the same length as one another in a direction extending orthogonally from the spine and are preferably made of metal. The second row of teeth 12 may have at least 20% more teeth per unit than the first row of teeth and the first row of teeth may be spaced at 8–10 teeth per centimeter (preferably 9 teeth per centimeter) and the teeth of the second row may be spaced 10–12 teeth per centimeter (preferably 11 teeth per centimeter).

The spacing between the teeth of the first row in a currently preferred embodiment is 0.48 mm and the spacing between the teeth of the second row is preferably 0.25 mm.

Also, in a currently preferred embodiment, the diameter of each tooth of the first and second rows of teeth is approximately 0.65 mm–0.75 mm but in a preferred embodiment, the first row of teeth, ie, the more widely spaced row, has a larger diameter than the second row of teeth.

In use, the hair comb is moved in the direction of arrow-headed line A shown in FIG. 4 so that the more widely spaced row of teeth move through the hair first performing a first coarse combing for head lice, nits and eggs with the second row of teeth forming a more fine filtering of head lice, nits and eggs.

It is to be understood that modifications could be made to the preferred embodiments and that all such modifications falling within the spirit and scope of the appended claims are intended to be included in the present invention.

What is claimed is:

1. A hair comb including a single spine and, extending from the spine in adjacent, substantially parallel planes, a first row of teeth and a closely spaced but not touching second row of teeth, the teeth of the first row of teeth being of substantially the same length as the teeth of the second row of teeth, said first and second rows of teeth being fixedly attached to said spine and in fixed distal relation to one another, the teeth of the second row of teeth being more closely spaced than the teeth of the first row of teeth, wherein the spacing of the teeth is arranged for the removal of at least one of head lice, nits and head lice eggs from combed hair.

2. A hair comb as claimed in claim 1 wherein, the teeth in at least one of the rows of teeth have a substantially cylindrical cross section.

3. A hair comb as claimed in claim 1 wherein, the teeth in at least one of the rows of teeth have rounded tips remote from the spine.

4. A hair comb as claimed in claim 1 wherein, the teeth in at least one of the rows of teeth are made of metal.

5. A hair comb as claimed in claim 1 wherein, the first and second rows of teeth extend in a direction substantially orthogonally from the spine.

6. A hair comb as claimed in claim 1 wherein, the second row of teeth has at least 20% more teeth per unit length than the first row of teeth.

7. A hair comb as claimed in claim 6 wherein, the teeth of the first row are spaced at 8 to 10 teeth per centimeter and the teeth of the second row are spaced at 10 to 12 teeth per centimeter.

8. A hair comb as claimed in claim 7 wherein, the teeth of the first row are spaced at 9 teeth per centimeter and the teeth of the second row are spaced at 11 teeth per centimeter.

9. A hair comb as claimed in claim 1 wherein, the spacing between the teeth of the first row is approximately 0.48 mm and the spacing between the teeth of the second row is approximately 0.25 mm.

10. A hair comb as claimed in claim 1 wherein, the diameter of each tooth of the first and second rows is approximately 0.65 mm to 0.75 mm.

11. A hair comb as claimed in claim 1 wherein, handle means is attached to the spine.

12. A hair comb as claimed in claim 1 wherein, the handle means is integrally formed with the spine and provided with grip means for assisting a user to grip the handle means.

13. A hair comb including a single spine and extending from the spine in adjacent substantially parallel planes, a first row of teeth and a closely spaced but not touching second row of teeth, the teeth of the first row of teeth being of substantially the same length as the teeth of the second row of teeth, said first and second rows of teeth being fixedly attached to said spine and in fixed distal relation to one another, the teeth of the second row of teeth being more closely spaced than the teeth of the first row of teeth so that the second row of teeth has at least 20% more teeth per unit length than the first row of teeth, wherein the spacing of the teeth is arranged for the removal of at least one of head lice, nits and head lice eggs from combed hair.

14. A hair comb including a single spine and extending from the spine in adjacent substantially parallel planes, a first row of teeth and a closely spaced but not touching second row of teeth, the teeth of the first row of teeth being of substantially the same length as the teeth of the second row of teeth, said first and second rows of teeth being fixedly attached to said spine and in fixed distal relation to one another, the teeth of the first row of teeth being spaced at 8 to 10 teeth per centimeter and the teeth of the second row of teeth being spaced at 10 to 12 teeth per centimeter, wherein the spacing of the teeth is arranged for the removal of at least one of head lice, nits and head lice eggs from combed hair.

15. A hair comb including a single spine and extending from the spine in adjacent substantially parallel planes, a first row of teeth and a closely spaced but not touching second row of teeth, the teeth of the first row of teeth being of substantially the same length as the teeth of the second row of teeth, said first and second rows of teeth being fixedly attached to said spine and in fixed distal relation to one another, the teeth of the second row of teeth being more closely spaced than the teeth of the first row of teeth and the spacing between the teeth of the first row being approximately 0.48 mm and the spacing between the teeth of the second row of teeth being approximately 0.25 mm, wherein the spacing of the teeth is arranged for removal of at least one of head lice, nits and head lice eggs from combed hair.

16. A hair comb including a single spine and extending from the spine in adjacent substantially parallel planes, a first row of teeth and a closely spaced but not touching second row of teeth, the teeth of the first row of teeth being of substantially the same length as the teeth of the second row of teeth, said first and second rows of teeth being fixedly attached to said spine and in fixed distal relation to one another, the second row of teeth having at least 20% more teeth per unit length than the first row of teeth, wherein the spacing of the teeth is arranged for removal of at least one of head lice, nits and head lice eggs from combed hair, and wherein a handle means is integrally formed with the spine and provided with grip means for assisting a user to grip the handle means.

* * * * *